US009322517B2

(12) United States Patent
Chu et al.

(10) Patent No.: US 9,322,517 B2
(45) Date of Patent: Apr. 26, 2016

(54) NON-GLARE REFLECTIVE LED LIGHTING APPARATUS WITH HEAT SINK MOUNTING

(75) Inventors: Tin Po Chu, Sham Tseng (HK); Wa Hing Leung, Tin Shiu Wai (HK)

(73) Assignee: Huizhou Light Engine Ltd., Guangdong (CN)

( * ) Notice: Subject to any disclaimer, the term of this patent is extended or adjusted under 35 U.S.C. 154(b) by 173 days.

(21) Appl. No.: 12/470,332

(22) Filed: May 21, 2009

(65) Prior Publication Data

US 2009/0290349 A1 Nov. 26, 2009

Related U.S. Application Data

(60) Provisional application No. 61/055,858, filed on May 23, 2008, provisional application No. 61/057,289, filed on May 30, 2008, provisional application No. 61/118,202, filed on Nov. 26, 2008.

(51) Int. Cl.
*F21V 7/04* (2006.01)
*F21K 99/00* (2010.01)
(Continued)

(52) U.S. Cl.
CPC ..... *F21K 9/137* (2013.01); *F21S 48/328* (2013.01); *F21V 7/0008* (2013.01);
(Continued)

(58) Field of Classification Search
CPC ..... F21V 7/04; F21V 7/09; F21V 7/20; F21V 29/004; F21V 15/01; F21V 21/30; F21V 29/02; F21S 48/1208; F21K 9/00
USPC ..... 362/373, 362, 341, 345, 350
See application file for complete search history.

(56) References Cited

U.S. PATENT DOCUMENTS 4,503,360 A * 3/1985 Bedel ..... 315/112
4,635,169 A 1/1987 Enaka
(Continued)

FOREIGN PATENT DOCUMENTS

CA 2 723 901 A1 11/2009
CN 1722484 A 1/2006
(Continued)

OTHER PUBLICATIONS

PCT International Search Report dated Sep. 15, 2009 in connection with PCT International Application No. PCT/CA2009/000689.
(Continued)

*Primary Examiner* — Jong-Suk (James) Lee
*Assistant Examiner* — Mark Tsidulko
(74) *Attorney, Agent, or Firm* — Schiff Hardin LLP

(57) ABSTRACT

A lighting apparatus using at least one light-emitting diode ("LED"), back-reflecting collection optics for LEDs, and an improved heat sink mounting apparatus which promotes efficient heat dissipation generated from the LED while minimizing light obstruction and glare. The lighting apparatus contains a main housing; a reflector disposed within the main housing, the reflector having a front side and a rear side; a top rim thermally coupled to one end of the main housing; a heat conducting body positioned to face the front side of the reflector, the heat conducting body comprising a heat pipe thermally coupled to the top rim; at least one light-emitting diode thermally coupled to the heat conducting body, the at least one light-emitting diode being positioned to face directly at the front side of the reflector so that light emitted from the at least one light-emitting diode is directed to the front side of the reflector.

20 Claims, 19 Drawing Sheets

(51) Int. Cl.

| | |
|---|---|
| ***F21S 8/10*** | (2006.01) |
| ***F21V 7/00*** | (2006.01) |
| ***F21V 23/00*** | (2015.01) |
| ***F21V 29/00*** | (2015.01) |
| ***F21V 19/00*** | (2006.01) |
| ***F21V 29/507*** | (2015.01) |
| ***F21V 29/77*** | (2015.01) |
| ***F21V 29/85*** | (2015.01) |
| ***F21V 29/89*** | (2015.01) |
| *F21V 7/06* | (2006.01) |
| *F21V 7/07* | (2006.01) |
| *F21V 7/08* | (2006.01) |
| *F21Y 101/02* | (2006.01) |
| *F21V 29/505* | (2015.01) |

(52) U.S. Cl.

CPC ..... *F21V 19/0015* (2013.01); *F21V 23/005* (2013.01); *F21V 29/006* (2013.01); *F21V 29/507* (2015.01); *F21V 29/773* (2015.01); *F21V 29/85* (2015.01); *F21V 29/89* (2015.01); *F21V 7/048* (2013.01); *F21V 7/06* (2013.01); *F21V 7/07* (2013.01); *F21V 7/08* (2013.01); *F21V 29/505* (2015.01); *F21Y 2101/02* (2013.01)

(56) References Cited

U.S. PATENT DOCUMENTS

| | | | | |
|---|---|---|---|---|
| 4,837,667 | A | 6/1989 | Grau | |
| 4,897,771 | A | 1/1990 | Parker | |
| 5,400,226 | A | 3/1995 | Hogrefe | |
| 5,731,211 | A | 3/1998 | Ohlin | |
| 6,632,003 | B2 * | 10/2003 | Marquardt et al. | 362/267 |
| 6,976,769 | B2 * | 12/2005 | McCullough et al. | 362/345 |
| 7,093,952 | B2 * | 8/2006 | Ono et al. | 362/194 |
| 7,210,832 | B2 | 5/2007 | Huang | |
| 7,246,921 | B2 | 7/2007 | Jacobson et al. | |
| 7,413,326 | B2 | 8/2008 | Tain et al. | |
| 7,517,113 | B2 | 4/2009 | Bruckner | |
| 7,565,925 | B2 | 7/2009 | Lee et al. | |
| 7,742,225 | B2 | 6/2010 | Wu et al. | |
| 7,789,534 | B2 | 9/2010 | Wang | |
| 7,976,197 | B2 | 7/2011 | Chen | |
| 2004/0252502 | A1 | 12/2004 | McCullough et al. | |
| 2005/0111234 | A1 | 5/2005 | Martin et al. | |
| 2005/0168994 | A1 | 8/2005 | Jacobson et al. | |
| 2005/0185417 | A1 | 8/2005 | Mayer et al. | |
| 2007/0041197 | A1 * | 2/2007 | Saito et al. | 362/296 |
| 2007/0189017 | A1 * | 8/2007 | Hofmann | 362/345 |
| 2007/0236935 | A1 | 10/2007 | Wang | |
| 2007/0246824 | A1 * | 10/2007 | Gwin | 257/722 |
| 2008/0007954 | A1 | 1/2008 | Li | |
| 2008/0170392 | A1 | 7/2008 | Speier et al. | |
| 2010/0110679 | A1 | 5/2010 | Teng et al. | |
| 2010/0264800 | A1 | 10/2010 | Liu et al. | |

FOREIGN PATENT DOCUMENTS

| | | | |
|---|---|---|---|
| CN | 102037279 | A | 4/2011 |
| CN | 102087004 | A | 6/2011 |
| DE | 102010030296 | A1 | 12/2011 |
| EP | 1371901 | A2 | 12/2003 |
| EP | 2397753 | A1 | 12/2011 |
| JP | J1-159306 | | 11/1989 |
| JP | 08-096605 | | 4/1996 |
| JP | 10-217845 | | 8/1998 |
| JP | 2002-168575 | | 6/2002 |
| JP | 2004-127716 | | 4/2004 |
| JP | 2004-172507 | | 6/2004 |
| JP | 2006-202612 | | 8/2006 |
| JP | 2008-108721 | A | 5/2008 |
| TW | 201007085 | A | 2/2010 |
| TW | 201038868 | A | 11/2010 |
| TW | 201038870 | A | 11/2010 |
| WO | WO-2004/111530 | A2 | 12/2004 |
| WO | WO-2006/033998 | A1 | 3/2006 |
| WO | WO-2006/034755 | A1 | 4/2006 |
| WO | WO-2007/146566 | A2 | 12/2007 |
| WO | WO-2008/023707 | A1 | 2/2008 |
| WO | WO-2008/093978 | A1 | 8/2008 |
| WO | WO-2009/007905 | A2 | 1/2009 |
| WO | WO-2009-140761 | A1 | 11/2009 |
| WO | WO-2009140761 | A1 | 11/2009 |
| WO | WO-2010-150170 | A1 | 12/2010 |

OTHER PUBLICATIONS

PCT Written Opinion of the International Searching Authority dated Sep. 15, 2009 in connection with PCT International Application No. PCT/CA2009/000689.

Notification of Transmittal of the International Search Report and The Written Opinion of the International Searching Authority, issued for PCT/CA2012/050204, date of mailing Oct. 29, 2012.

Search Report dated Feb. 3, 2015 for Taiwanese Patent Application No. 101111452 (with English translation).

European Patent Office, office action date mailed Oct. 28, 2011, issued for corresponding application EP 09 749 365.4.

Apr. 29, 2013 Search Report issued in connection with Singapore Application No. 2011029709.

Apr. 30, 2013 Written Opinion issued in connection with Singapore Application No. 201102970-9.

May 4, 2011 Australian Office Action in connection with Australian Patent Application No. 2009250290.

Jul. 23, 2013 Final Office Action for Japanese Patent Appl. No. 2011-509828 (with English translation).

Office Action dated Jan. 30, 2015 for Chinese Patent Application No. 201280067140.X (with English translation).

Supplementary European Search Report dated Sep. 16, 2015 for European Patent Application No. 12869302.5.

* cited by examiner

NON-GLARE REFLECTIVE LED LIGHTING APPARATUS WITH HEAT SINK MOUNTING

CROSS-REFERENCE TO RELATED APPLICATIONS

This is a utility application claiming priority under 35 U.S.C. §119(e) of U.S. Provisional Patent Application Ser. No. 61/055,858, filed May 23, 2008, U.S. Provisional Patent Application Ser. No. 61/057,289, filed May 30, 2008, and U.S. Provisional Patent Application Ser. No. 61/118,202, filed Nov. 26, 2008, the entirety of which are incorporated herein by reference.

Throughout this application, several patents and references are referenced. Disclosure of these patents and references in their entirety is hereby incorporated by reference into this application.

FIELD OF THE INVENTION

The present invention relates to electrical lighting devices and systems and, more specifically, lighting apparatuses using at least one single-chip or multi-chip light-emitting diode ("LED"), back-reflecting collection optics for LEDs, and an improved heat sink mounting apparatus which promotes efficient heat dissipation generated from the LED while minimizing light obstruction and glare.

BACKGROUND OF THE INVENTION

For years, people have used traditional incandescent or fluorescence lighting apparatuses in order to address their interior lighting concerns. However, such lighting apparatuses present a number of drawbacks. For example, the popular AR111 halogen apparatus presents the following drawbacks—relatively high power consumption, inefficiency of light dispersion due to the placement of its metal shield in the line sight of the halogen bulb, and its limited effectiveness in preventing glare from the halogen bulb.

Recently, a number of LED lighting apparatuses have been designed to replace the AR111 halogen apparatus, as well as other traditional incandescent or fluorescence lighting apparatuses. Typically, in such LED lighting apparatuses, the LED light source is located at the center of a reflector with its light emission directed outward from the reflector. Additionally, there are LED lighting apparatuses, such as PAR38, which use multiple LEDs with their light emissions directed outward from one or more reflectors. These configurations are unable to achieve narrow beam angles, and result in considerable glare since observers are not shielded from the LED light source. Further, these configurations inefficiently distributes heat; thereby, making the use of high-powered LEDs in these configurations practically prohibitive.

To address these problems, alternative LED lighting apparatuses which use a mirror or reflective surface to reflect light back in the direction of the LED light source have been disclosed. See, e.g., U.S. Pat. No. 6,976,769 to McCullough et al. entitled "Light-Emitting Diode Reflector Assembly Having a Heat Pipe," U.S. Pat. No. 7,246,921 to Jacobson et al. entitled "Back-Reflecting LED Light Source", and PCT International Publication No. WO 2006/033998 to Magna International Inc. entitled "Thermal Management System for Solid State Automotive Lighting."

SUMMARY OF THE INVENTION

In light of the above, there exists a need to further improve the art. Specifically, there is a need for an LED lighting apparatus that eliminates or reduces glare, and has an improved, compact thermally-conductive assembly which promotes efficient heat dissipation generated from the LED (such as a high-powered LED) while minimizing obstruction of the light path and the number of components needed in such assembly.

In accordance with an aspect of the present invention, a lighting apparatus comprises a main housing; a reflector disposed within the main housing, the reflector having a front side and a rear side; a top rim thermally coupled to one end of the main housing; a heat conducting body positioned to face the front side of the reflector, the heat conducting body comprising a heat pipe thermally coupled to the top rim; at least one light-emitting diode thermally coupled to the heat conducting body, the at least one light-emitting diode being positioned to face directly at the front side of the reflector so that light emitted from the at least one light-emitting diode is directed to the front side of the reflector. The light emitted from the at least one LED is substantially or entirely directed to the front side of reflector, and is substantially or entirely reflected from the front side of reflector past the at least one LED and the heat conducting body.

According to another aspect of the present invention, the heat conducting body is substantially S-shaped and comprises a middle portion that is bar-shaped; and curved wing portions extending from the middle portion, each the curved wing portion being coupled to the top rim. The middle portion of the heat conducting body can also be substantially bar-shaped.

According to another aspect of the present invention, the heat conducting body provides a pathway for heat to flow from the at least one light-emitting diode toward the top rim.

According to another aspect of the present invention, the reflector has a central optical axis; the lighting apparatus further comprising a mounting platform coupled to the heat conducting body and positioned near or at the central optical axis of the reflector and thermally coupled to the at least one light-emitting diode. The mounting platform is made of thermally-conductive material such as copper, aluminum or any other high-heat conductive material.

According to another aspect of the present invention, the heat conducting body is bar-shaped, and wherein at least one end of the heat conducting body is thermally coupled to the top rim.

According to another aspect of the present invention, the reflector has a central optical axis, and wherein one end of the heat conducting body is positioned near or at the central optical axis of the reflector, and is thermally coupled to the at least one light-emitting diode.

According to a further aspect of the present invention, the lighting apparatus further comprises a metal cladding coupled to at least a substantial portion of the heat conducting body. The metal cladding is made of a thermally-conductive material such as stainless steel, aluminum, copper or any other high-heat conductive material.

According to another aspect of the present invention, the reflector is in the shape of a hyperbola, ellipse or parabola.

According to another aspect of the present invention, the top rim is circular and is made of a thermally-conductive material, such as aluminum, copper, zinc or other high-heat conductive material.

According to another aspect of the present invention, the main housing is substantially frustoconical in shape, and is made of a thermally-conductive material (such as aluminum, copper, zinc or any other high-heat conductive material). The main housing can include one or more heat dissipating fins. The main housing can also be cylindrical or cubical in shape.

According to a further aspect of the present invention, the lighting apparatus further comprises a plastic housing, coupled to the main housing; and a lamp base coupled to the plastic housing.

According to another aspect of the present invention, the lamp base is an E26 lamp base, a GU10 lamp base, an E27 lamp base, or a GU24 lamp base.

According to a further aspect of the present invention, the lighting apparatus further comprises a mounting plate thermally coupled to the at least one light-emitting diode; and a mounting platform thermally coupled to the mounting plate and the heat conducting body. The mounting plate is made of a thermally-conductive material, such as copper or any other high-heat conductive material.

According to a further aspect of the present invention, the lighting apparatus further comprises a glass cover coupled to the top rim, wherein the glass cover at least covers the reflector, the heat conducting body, and the at least one light-emitting diode from external environment.

According to another aspect of the present invention, a lighting apparatus comprising a main housing having a generally frustoconical shape; a conic-shaped reflector disposed within the main housing, the conic-shaped reflector having a front side, a rear side and a central optical axis; a circular top rim coupled to the main housing; a substantially S-shaped heat pipe positioned to face the front side of the conic-shaped reflector, the substantially S-shaped heat pipe comprising a middle portion comprising a mounting platform located at or near the central optical axis of the conic-shaped reflector, and two curved wing portions, the curved wing portions respectively coupled to each end of the middle portion and coupled within the top rim; at least one light-emitting diode thermally coupled to the mounting platform and positioned facing directly at the front side of the conic-shaped reflector so as that light emitted from the at least one light-emitting diode is directed to the front side of the conic-shaped reflector.

According to a further aspect of the present invention, the lighting apparatus further comprises a metal core PCB coupled to the at least one light-emitting diode and the mounting platform.

BRIEF DESCRIPTION OF THE DRAWINGS

For the purposes of illustrating the present invention, the drawings reflect a form which is presently preferred; it being understood however, that the invention is not limited to the precise form shown by the drawings in which.

DETAILED DESCRIPTION OF THE INVENTION

Figure 3:
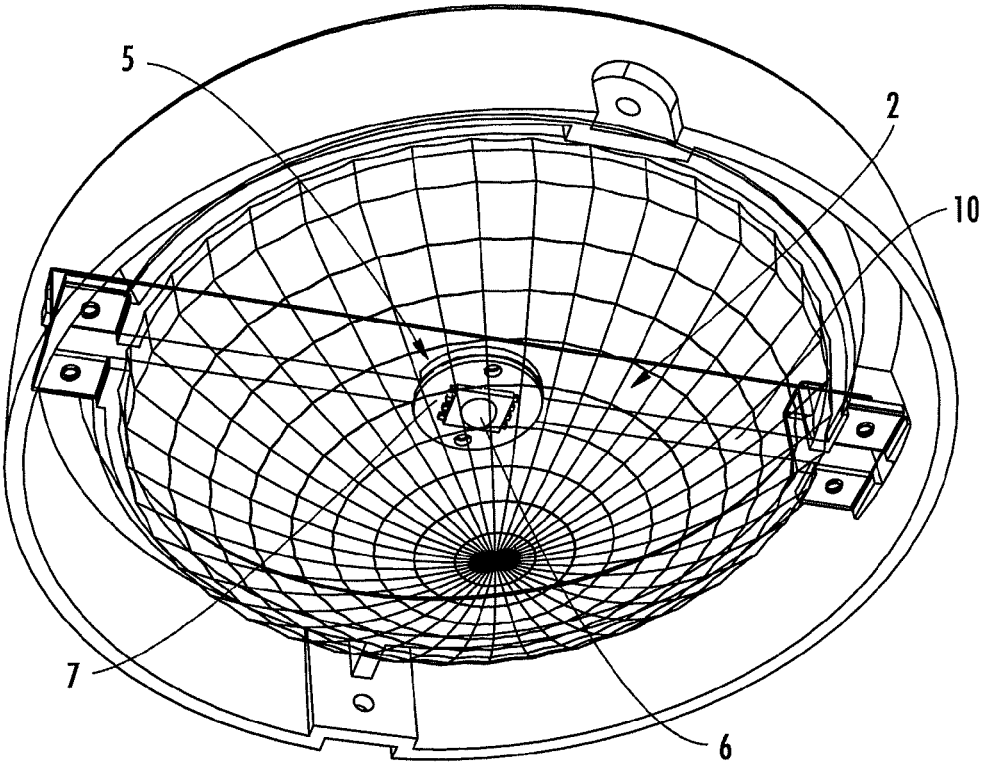
FIG. 3 is an "X-ray" view from the bottom side of the lighting apparatus shown in FIG. 3.

As shown in FIGS. 1-6, and in accordance with an aspect of the present invention, a lighting apparatus 1 has a reflector 4 which is coupled to a top rim 3, wherein the top rim 3 is coupled to a heat conducting body 2. The heat conducting body 2 contains a heat pipe 8 which is cladded by a cladding 9, and a mounting platform 5 located on one side of the heat conducting body 2 facing opposite the front side of the reflector 4. As shown in FIG. 3, an LED 6 is coupled to a metal core printed circuit board ("PCB") 7 which is then coupled to the mounting platform 5. The mounting platform 5 is shaped (which, in this aspect of the present invention, is circular) in such a manner that it provides increased non-glare protection from the LED relative to existing lighting apparatuses.

Figure 6:
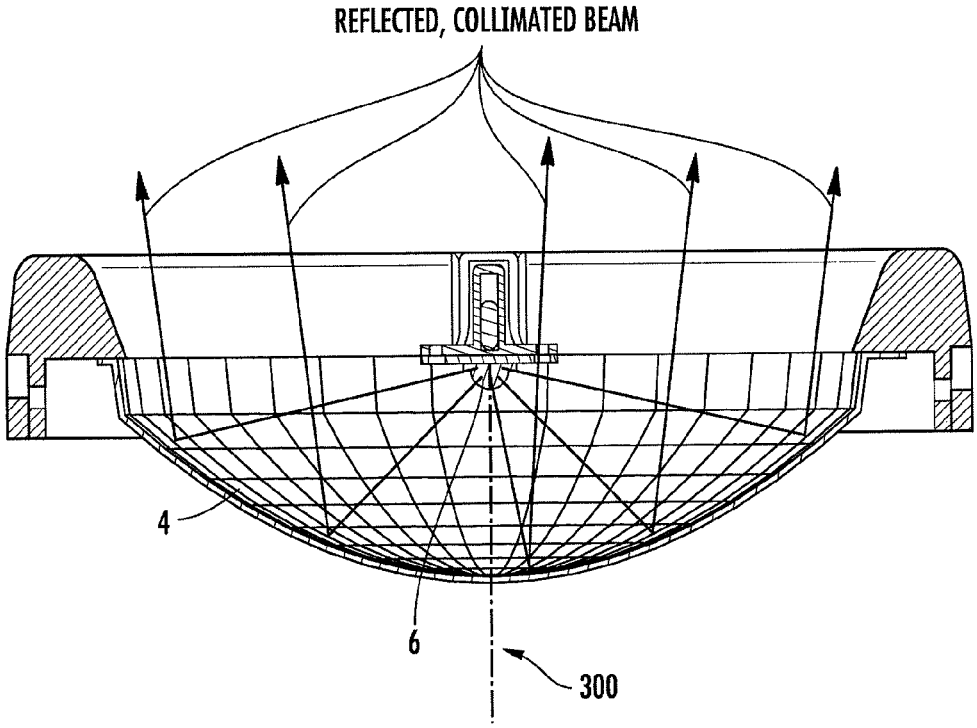
FIG. 6 is a cross-sectional view of the lighting apparatus shown in FIG. 1.

In this aspect of the present invention, the LED 6 is located above at or near a central optical axis 300 of the reflector 4, and is positioned so that light emitted from the LED 6 is substantially or entirely directed to the front side of the reflector 4; thereby, as shown in FIG. 6, allowing the reflector 4 to collect and colliminate the light emitted from LED 6, and reflect the colliminated light away from the reflector 4 and past LED 6 and the heat conducting body 2. The heat conducting body 2 intercepts very little of the exiting reflected, colliminated light from reflector 4 due to its flat, narrow construction. As shown in FIG. 3, the flat, narrow construction of the heat conducting body 2 creates a small cross-section 10 to the exiting reflected, colliminated light from reflector 4.

In this aspect of the present invention, the heat generated from the LED 6 travels the following heat path through the lighting apparatus: metal core PCB 7, mounting platform 5, cladding 9, heat pipe 8, cladding 9, and then top rim 3 and reflector 4. The heat generated from the LED 6 can also travel through metal core PCB 7, mounting platform 5, cladding 9, heat pipe 8, and then top rim 3 and reflector 4. The top rim 3 and reflector 4 act as heat sinks.

Figure 10:
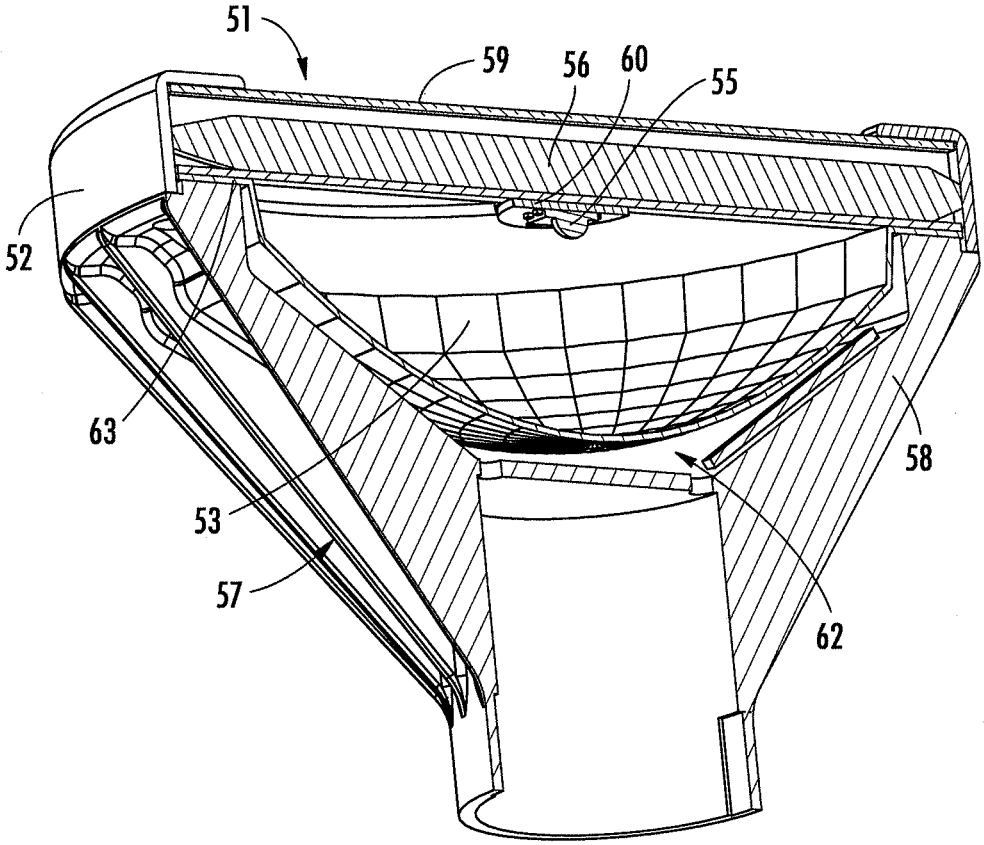
FIG. 10 is a cross-sectional perspective view of the lighting apparatus shown in FIG. 8.
Figure 11:
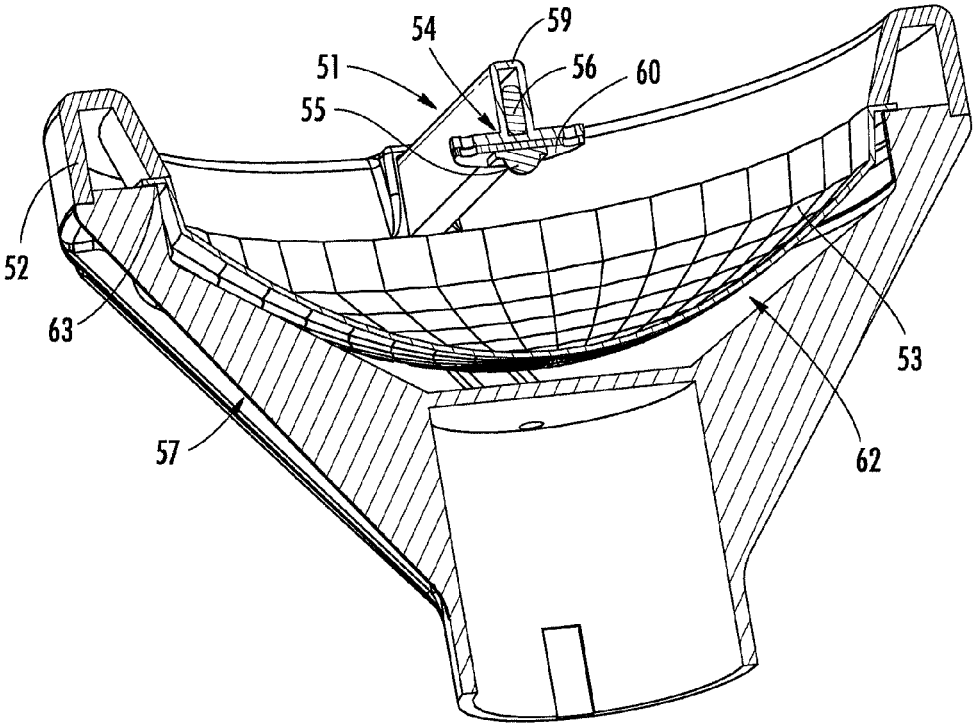
FIG. 11 is another cross-sectional perspective view of the lighting apparatus shown in FIG. 8.

Another aspect of the present invention is shown in FIGS. 8-13. Specifically, the lighting apparatus 50 contains a reflector 53 which is coupled to a top rim 52, wherein the top rim 52 is coupled to a heat conducting body 51. The heat conducting body 51 contains a heat pipe 56 which is cladded by a cladding 59, and a mounting platform 54 located on one side of the heat conducting body 51 facing opposite the reflector 53. The LED 55, as shown in FIG. 11, is coupled to a metal core PCB 60 which is then coupled to the mounting platform 54.

This aspect of the present invention includes a main housing 57 which has one or more heat dissipating fins 58 for maximizing surface area; thereby, increasing its heat dissipation capacity. The top rim 52, reflector 53, and the main housing 57 act as heat sinks, with the main housing 57 acting as the primary heat sink.

As shown in FIGS. 10 and 11, the main housing 57 is coupled to a reflector edge 63. There is an air gap 62 between the reflector 53 and the main housing 57, as shown in FIGS. 10 and 11. The size of air gap 62 can vary depending on the size of the reflector 53. The heat generated from the LED 55 travels a heat path which includes travelling through metal core PCB 60, mounting platform 54, cladding 59, heat pipe 56, cladding 59, and then top rim 52, reflector 53 and main housing 57. The heat can also travel through metal core PCB 60, mounting platform 54, cladding 59, heat pipe 56, and then top rim 52, reflector 53 and main housing 57.

Figure 18:
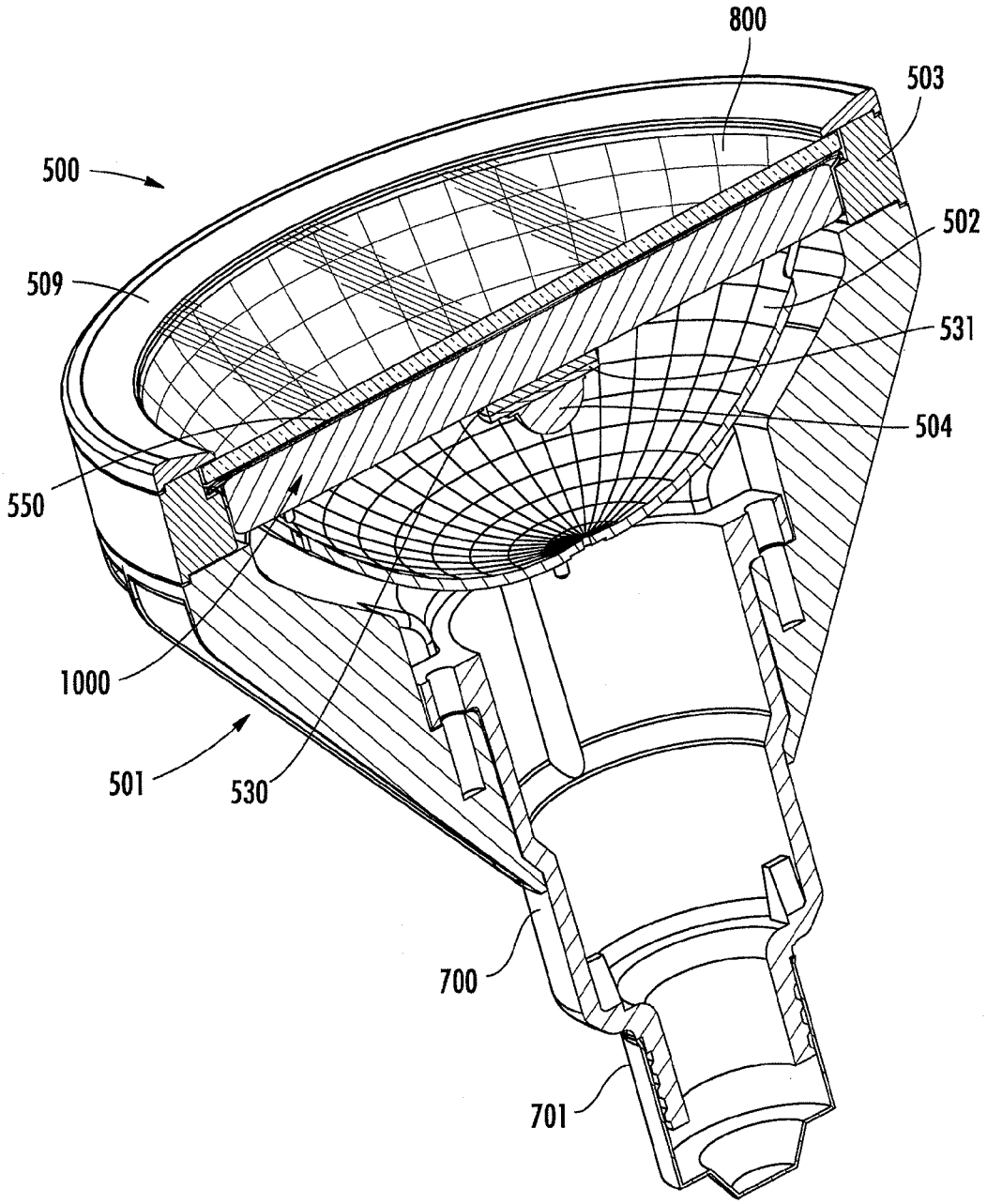
FIG. 18 is a cross-sectional perspective view of the lighting apparatus shown in FIG. 16.
Figure 19:
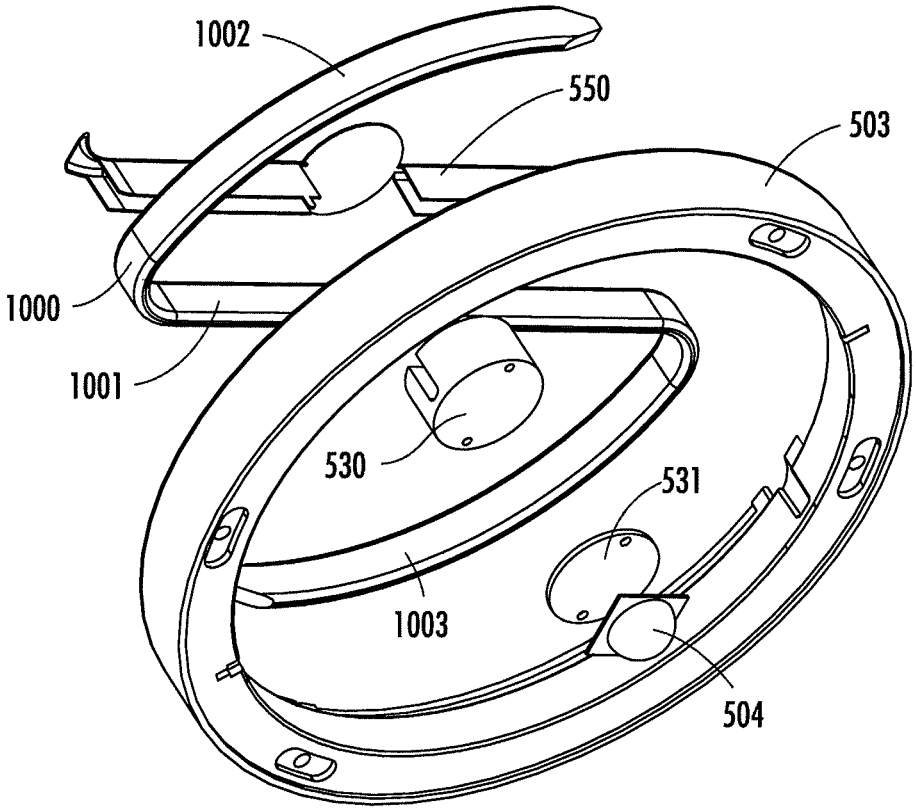
FIG. 19 is an exploded perspective view of the top rim and a heat sink mounting apparatus (which includes a metal cladding, an S-shaped heat conducting body, a mounting platform, a mounting plate, and an LED) of the lighting apparatus shown in FIG. 16.
Figure 20:
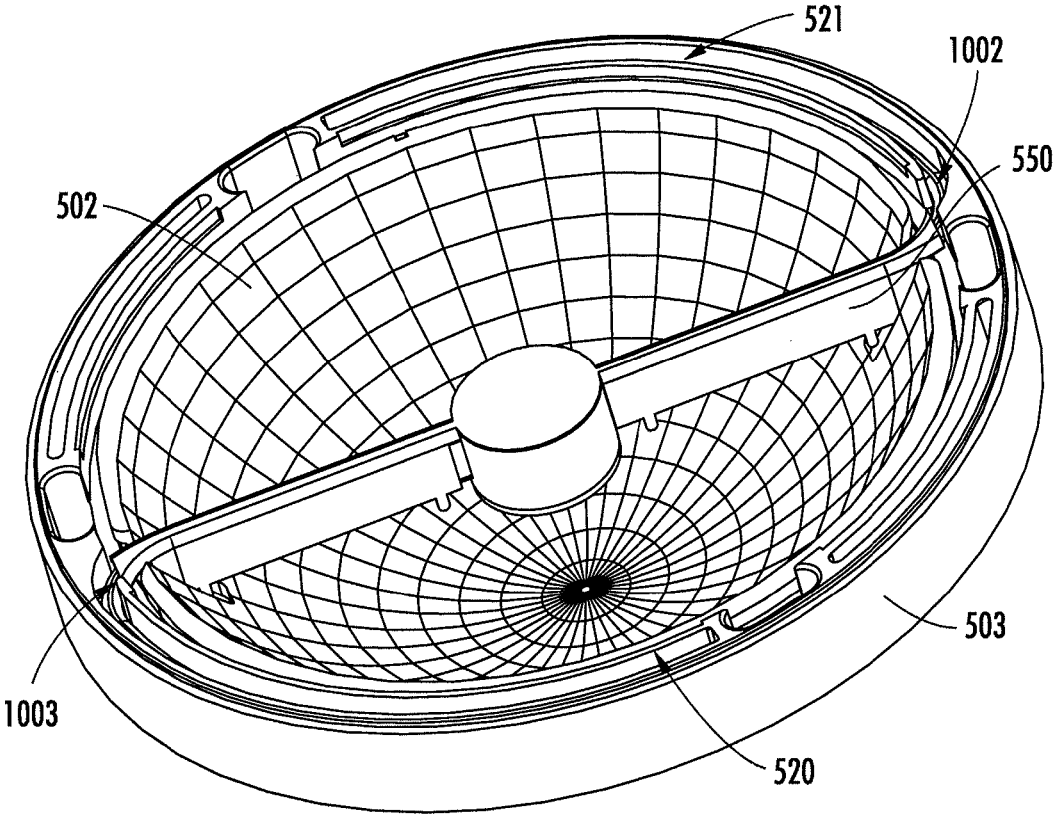
FIG. 20 is a perspective view from the top side (without a glass cover) of the lighting apparatus shown in FIG. 16.

Another aspect of the present invention is shown in FIGS. 18-20. Here, the lighting apparatus 500 includes a main housing 501; a reflector 502 having a front side and a rear side; a top rim 503 coupled to the main housing 501; a heat conducting body 1000 which is positioned on the front side of the reflector 502 and coupled to the top rim 503; an LED 504 being positioned facing directly at the front side of the reflector 502 so that light emitted from the LED 504 is substantially or entirely directed to the front side of the reflector 502. As shown in FIG. 18, a bottom platform of the top rim 503 can be coupled to a top end of the main housing 501.

As shown in FIG. 19, the heat conducting body 1000 is substantially S-shaped and includes a middle portion 1001 that is bar-shaped or substantially bar-shaped; and curved wing portions 1002 and 1003 which extend from each end of the middle portion 1001. As shown in FIG. 20, curved wing portions 1002 and 1003 are coupled to the top rim 503, wherein the top rim 503 has slots 520 and 521 formed in a top platform of the top rim 530 which permit the curved wing portions 1002 and 1003 to fit within the slots 520, 521, respectively; thereby, permitting coupling of the heat conducting body 1000 and the top rim 503. The heat conducting body 1000 and the top rim 503 can also be coupled via soldering, thermal epoxy or any other techniques known in the art which are used to couple the heat conducting body 1000 to the top rim 503.

The heat conducting body 1000 includes a mounting platform 530 which is positioned near or at the central optical axis of the reflector 502, and a mounting plate 531 coupled between the mounting platform 530 and LED 504. The heat conducting body 1000 also includes a heat pipe is located at the middle portion 1001 and/or one or both of the curved wing portions 1002 and 1003.

A metal cladding 550 can be coupled to the heat conducting body 1000. For example, as shown in FIG. 19, a substantial portion of the middle portion 1001 of the heat conducting body 1000 is coupled to the metal cladding 550. The metal cladding 550 can bemused to secure and direct electrical cable or wires which extends from the top rim 503 to the LED 504 along the middle portion 1001 of the heat conducting body 1000, and is made of a thermally-conductive material, such as stainless steel, aluminum, copper or any other high-heat conductive material.

As shown in FIG. 18, the present invention can include a glass cover 800 which is coupled to the top rim 503 and a cap rim 509. The cap rim 509 can be coupled to a top platform of the top rim 503. The glass cover 800 protects at least the reflector 502, the heat conducting body 1000, the mounting platform 530, the mounting plate 531 and LED 504 from environmental hazards, such as water and dust. The glass cover can also be used in conjunction with the aspects of the present invention set forth in FIGS. 1-6 and 8-13.

The present invention can also include a plastic housing 700 that is coupled to the bottom end of the main housing 501, and a lamp base 701 (e.g., an E26 lamp base, a GU10 lamp base, an E27 lamp base) that is coupled to the plastic housing 700.

Heat Conducting Body

Figure 4:
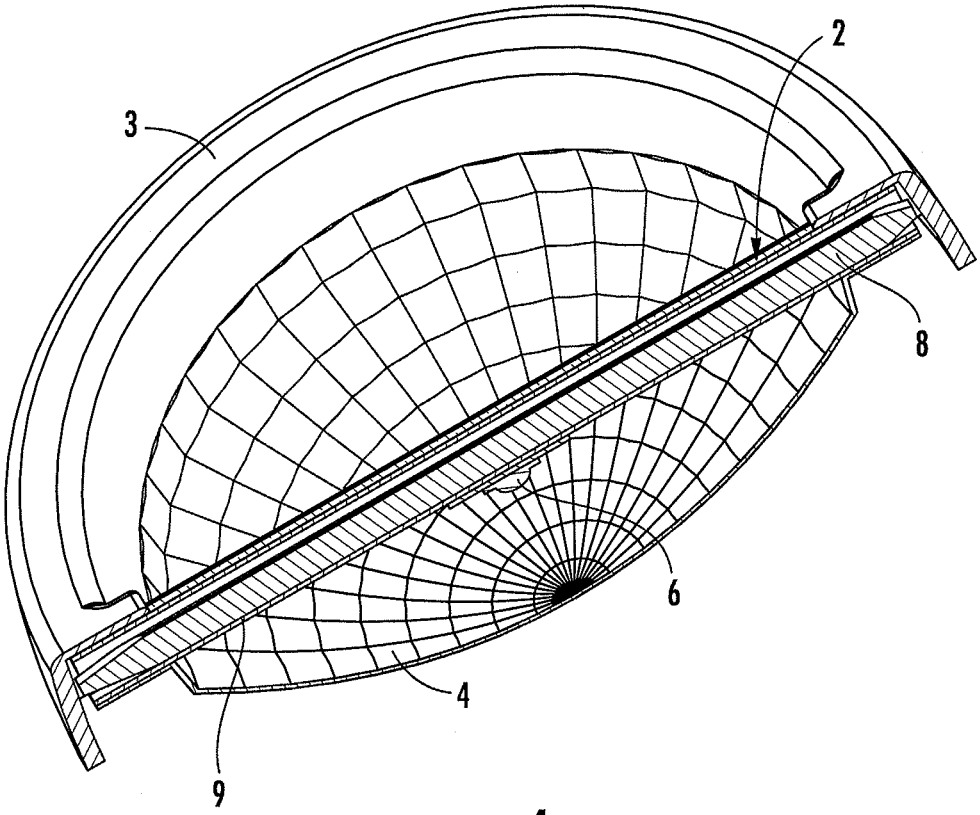
FIG. 4 is a cross-sectional perspective view from the top side of the lighting apparatus shown in FIG. 1.
Figure 5:
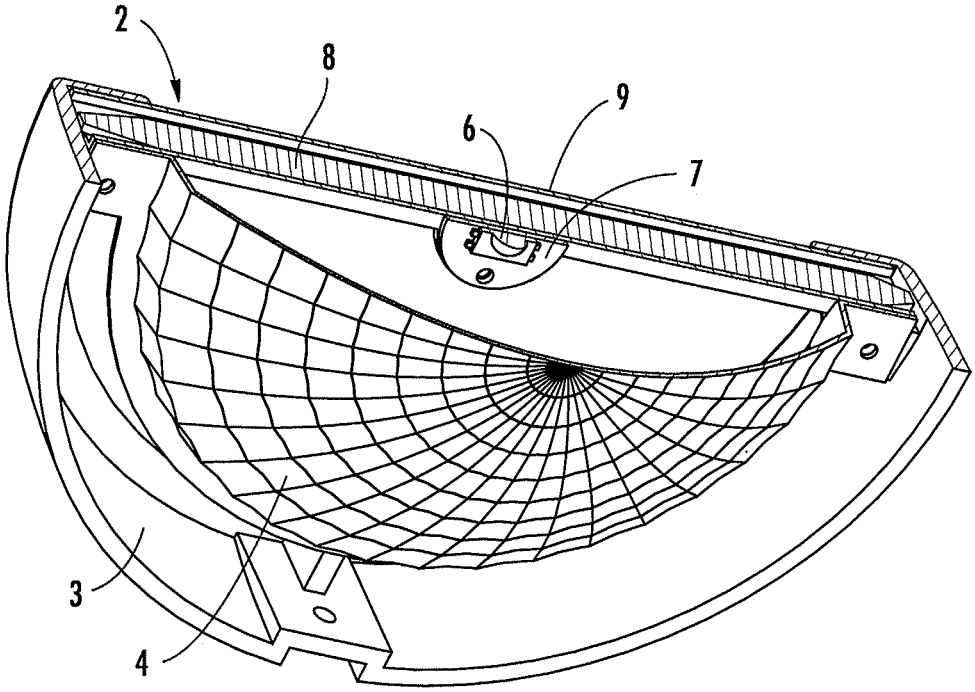
FIG. 5 is a cross-sectional perspective view from the bottom side of the lighting apparatus shown in FIG. 1.

As shown in FIGS. 4 and 11, the heat conducting body 2, 51 contain a heat pipe 8, 56 which is cladded by a cladding 9, 59, and a mounting platform 5, 54 located on one side of the heat conducting body 2, 51 facing opposite the reflector 4, 53. The cladding 9, 59 can be made of a thermally-conductive material such as aluminum, copper, graphite or zinc, and can include a mounting platform 5, 54. The cladding 9, 59 can be used to increase structural strength of the heat pipe 8, 56, assist in transferring and spreading the heat from the LED 6, 55 to the heat pipe, and assist in the transferring and spreading the heat from the heat pipe 8, 56 to the heat sinks, such as top rim 3, 52, reflector 4, 53 and main housing 57.

As discussed above, and as shown in FIG. 19, the heat conducting body 1000 can be coupled to a metal cladding 550. Metal cladding 550 covers a substantial portion of the middle portion 1001 of the heat conducting body 1000, and is used for aesthetic purposes, securing electric cable or wires between heat conducting body 1000 and metal cladding 550, and/or directing such electric cable or wires to the LED 504. The metal cladding 550 can be made of thermally-conductive material, such as stainless steel, aluminum, copper or any other high-heat conductive material.

Figure 14:
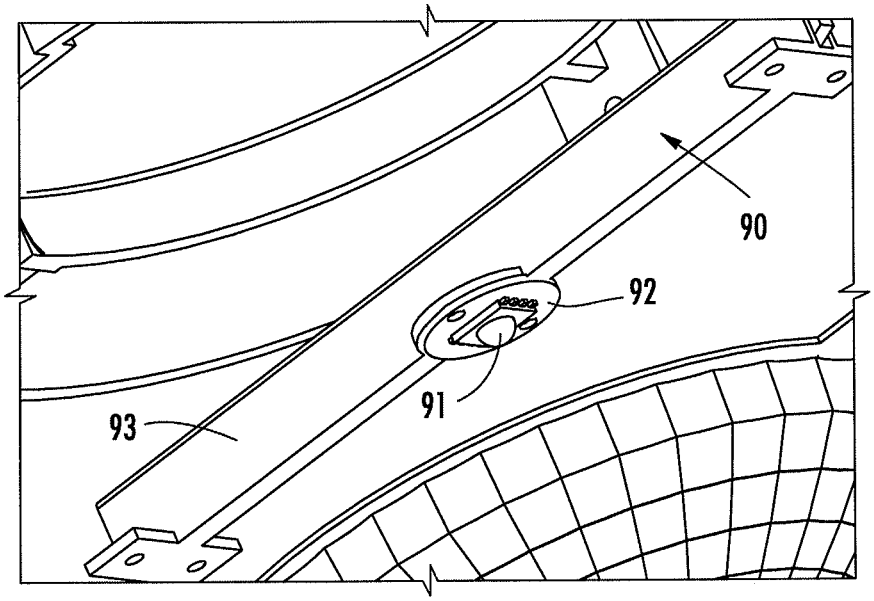
FIG. 14 is a perspective view of a heat conducting body (cladded heat pipe) with an LED coupled directly onto according to an aspect of the present invention.

Alternatively, as shown in FIG. 14, the LED 91 can be directly affixed onto a heat conducting body 90 (via the mounting platform 92 of cladding 93).

Figure 15:
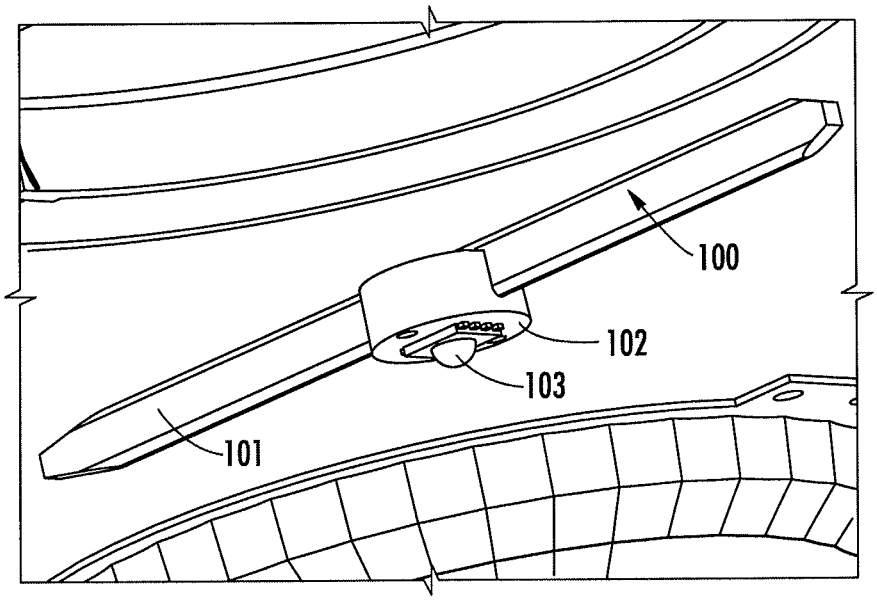
FIG. 15 is a perspective view of a heat conducting body (non-cladded heat pipe) with an LED coupled directly onto according to another aspect of the present invention.

In another aspect of the present invention, the heat pipe is not cladded. For example, FIG. 15 shows a heat conducting body 100 wherein an LED 103 is coupled onto a mounting platform 102, which is, in turn, directly coupled to a heat pipe 101. The mounting platform 102 can be cylindrically-shaped, and can partially or completely encase at least the center of the heat pipe 101.

Figure 7:
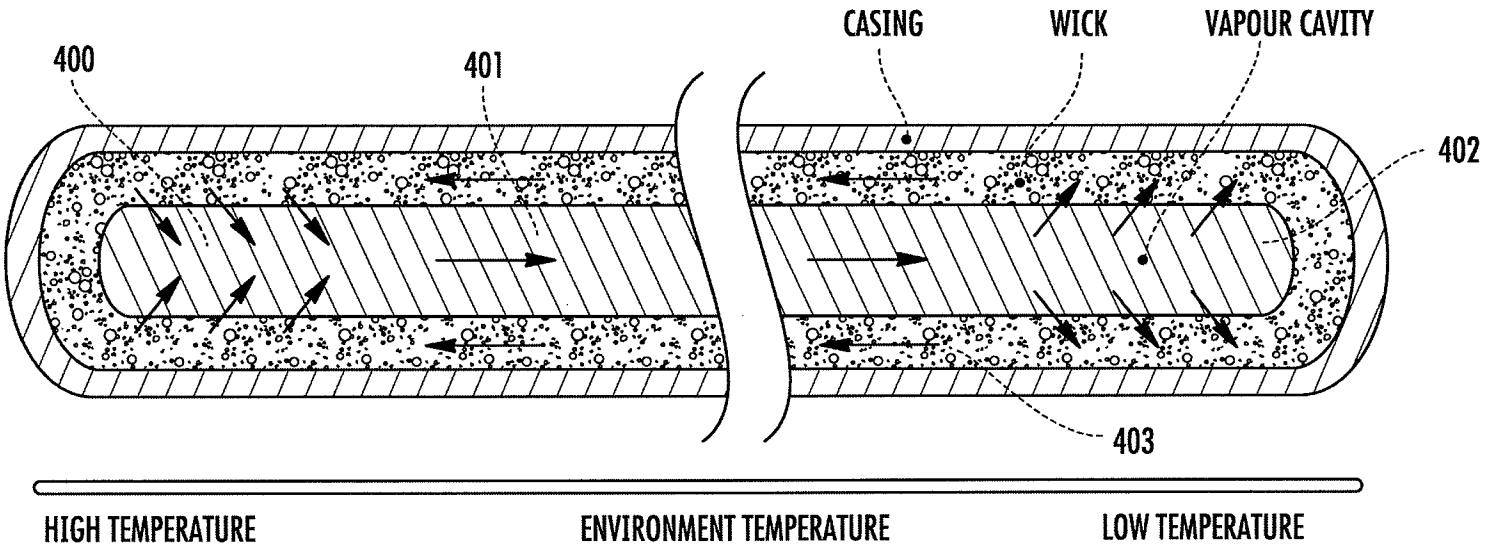
FIG. 7 PRIOR ART
FIG. 7 is a cross-sectional view of a known heat pipe (from http://en.wikipedia.org/wiki/Image:Heat_Pipe_Mechanism.png)

The heat pipe (such as heat pipe 8, 56, 101) can be made of porous copper incorporating a large number cavities filled with pure water. As shown in FIG. 7, water within the heat pipe evaporates to vapor as it absorbs thermal energy from a heat source. See 400 in FIG. 7. The vaporized water then migrates along the vapor cavity to cooler sections of the heat pipe. See 401 in FIG. 7. There, the vapor quickly cools and condenses back to fluid, and the fluid is absorbed by the wick, releasing thermal energy. See 402 in FIG. 7. The fluid then returns along the inner cavities to the heated sections (See. 403 in FIG. 7), and repeats the heat pipe thermal cycle described above. The heat pipe use the above-described mechanism to transmit thermal energy from the LED to heat sinks, such as the top rim 3, 52, reflector 4, 53, and main housing 57, 501.

The heat pipe can be flattened (in a cross-section direction) into a thin strip in order to minimize light absorption.

Another aspect of the present invention includes a heat conducting body with one or more heat pipes. For multiple heat pipes, each heat pipe is connected to a center hub (like a spoke on a wheel) positioned near or at the central optical axis of a reflector. The center hub acts as a mounting platform for one or more LEDs, and is made of thermally-conductive material such as aluminum, copper or any other high-heat conductive material.

Figure 1:
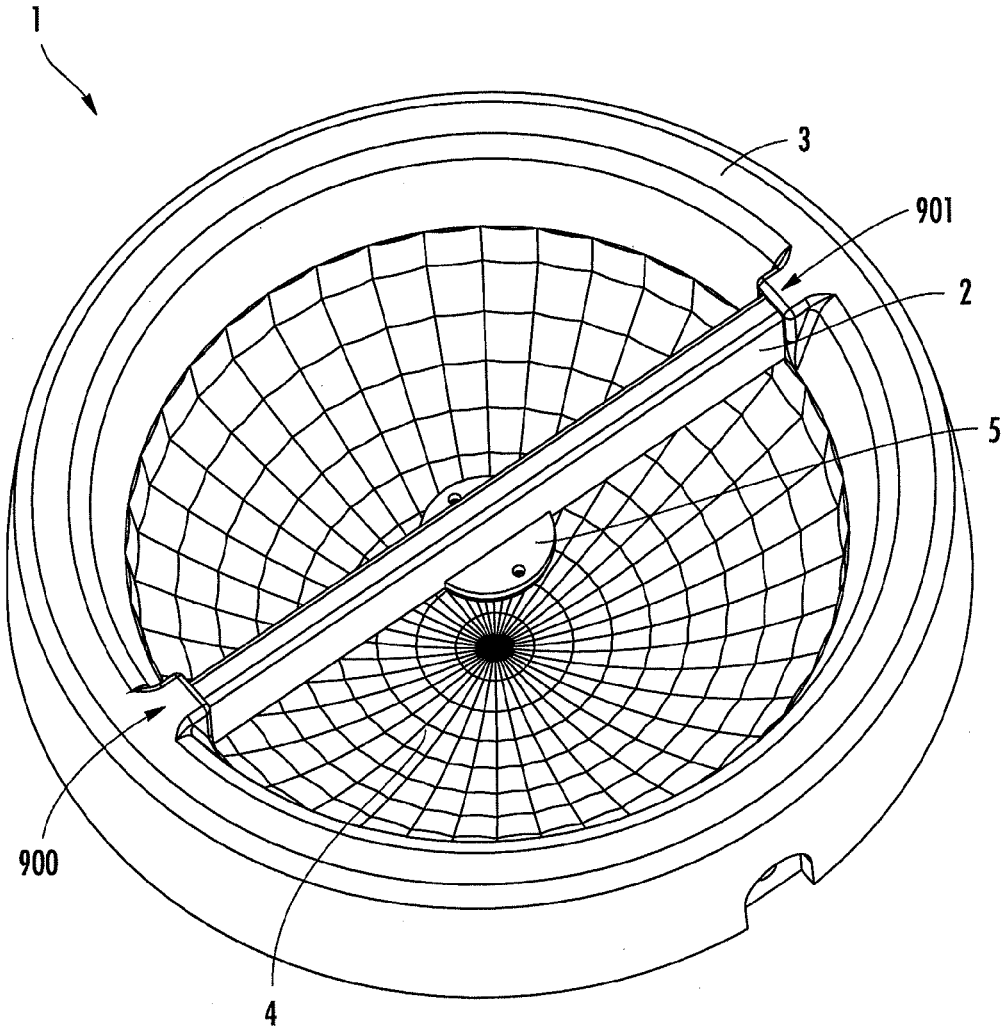
FIG. 1 is a perspective view from the top side of a lighting apparatus according to an aspect of the present invention.
Figure 2:
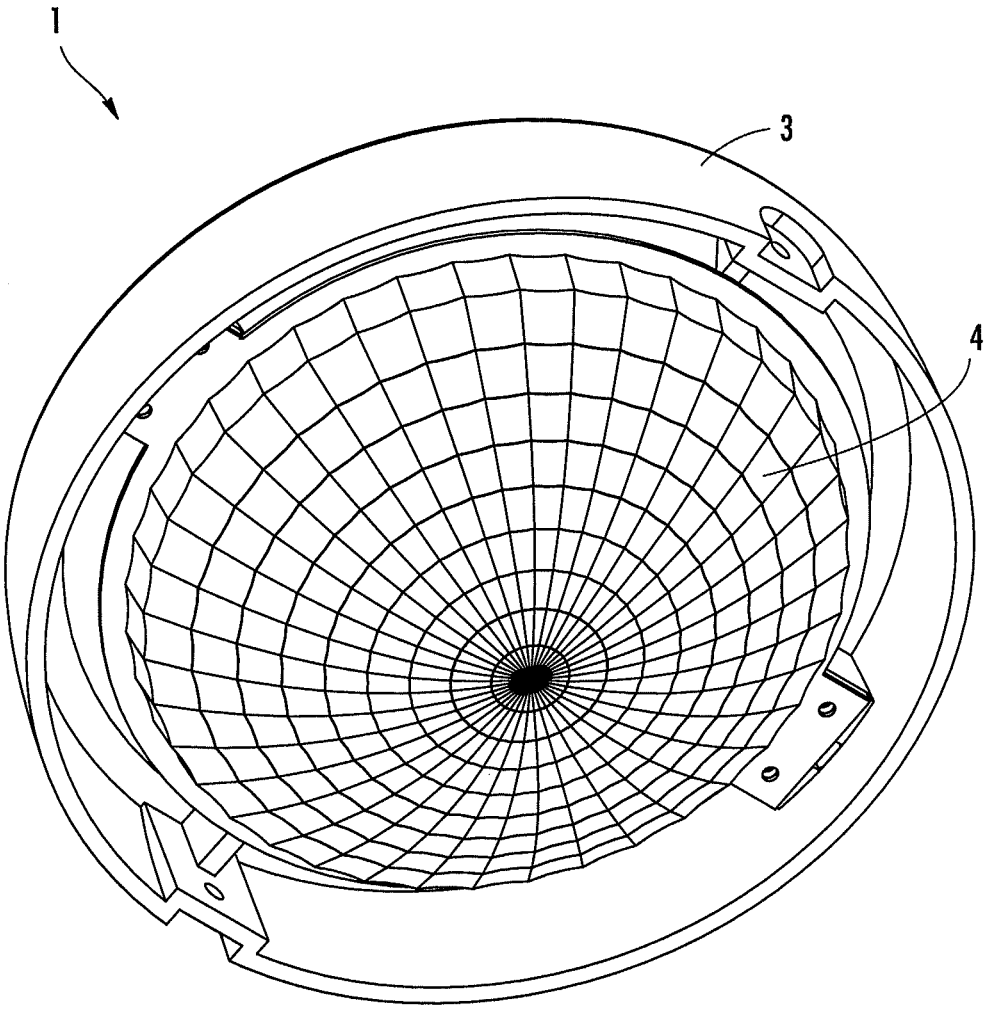
FIG. 2 is a perspective view from the bottom side of the lighting apparatus shown in FIG. 1.
Figure 8:
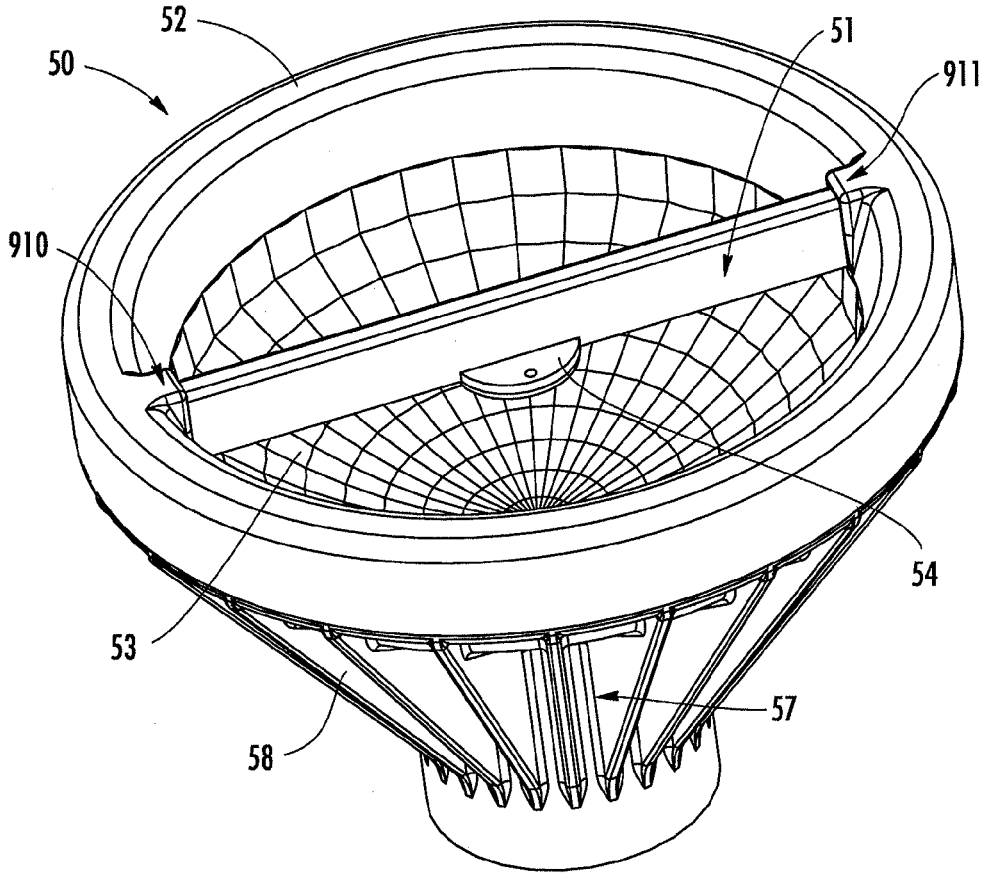
FIG. 8 is a perspective view of a lighting apparatus according to another aspect of the present invention.
Figure 9:
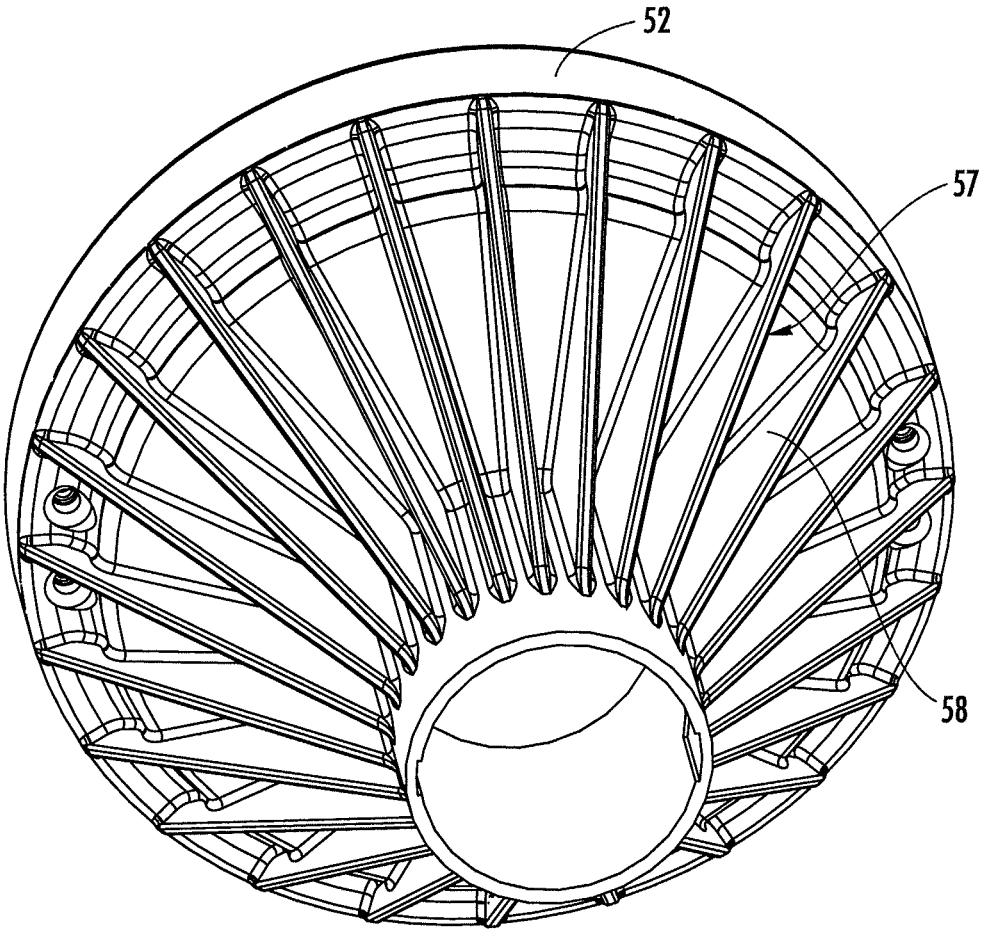
FIG. 9 is a perspective view from the bottom side of the lighting apparatus shown in FIG. 8.

In another aspect of the present invention, the heat conducting body extends up to or near the central axis of a reflector and being coupled to the top rim at only one connection point (such as connection point 900 or 901 for FIG. 1, or connection point 910 or 911 for FIG. 8). As a result, the heat conducting body does not form a chord to or a diameter of the top rim of FIGS. 1 and 8. At or near the central axis of the reflector, the heat conducting body includes a mounting platform with an LED directly coupled thereto, or an LED coupled to a metal core PCB or a mounting plate, which is then coupled to the mounting platform. This alternative aspect of the present invention reduces light blockage caused by the heat conducting body and improves lens efficiency, while promoting heat dissipation and anti-glare.

The mounting platform 5, 54, 102, 530 are made of a thermally-conductive material such as aluminum, copper or any other high-heat conductive material. Also, as mentioned above, the mounting platform provides increased non-glare protection from the LED relative to existing light apparatuses. In the present invention, the possibility of direct glare from the LED is eliminated (or at least mitigated) since (1) the LED is coupled onto the mounting platform and positioned facing directly at the reflector so as that light emitted from the LED is substantially or entirely directed to the reflector, and (2) the mounting platform is shaped (e.g., circular) in a manner which prevents a direct view of the LED at any viewing angle.

Reflector

The reflector 4, 53, 502 are made of a thermally-conductive material such as aluminum, and act as a heat sink. Alternatively, the reflector 4, 53, 502 can be made of a non-thermally-conductive material such as plastic.

As shown in FIG. 6, light emitted from the LED 6 is substantially or entirely directed toward the reflector 4, wherein the reflector 4 collimates the light emitted from the LED 6 into a light beam and reflects the light beam with a particular beam angle. The beam angle can range from 2 to 60 Full Width Half Maximum ("FWHM") degree. To eliminate or reduce glare, the reflector 4 of the present invention is designed to collect substantially or entirely the light emitted from the LED 6, and redirect the light in a manner which eliminates (or at least mitigates) luminance of the present invention within a direct glare zone (i.e., approximately 45 to 85 degree with respect to vertical).

The reflector 4, 53, 502 can take a variety of shapes to achieve various light beam patterns. It can be shaped in any conic section (e.g., hyperbola, ellipse or parabola), used singularly or in various combinations, in two-dimension or three-dimensional shapes.

LED

An LED can be an LED module with one or more chips. The LED can be a high-powered LED. One or more LEDs can be used in the present invention.

The LED 6, 55, 504 are coupled to a metal core PCB 7, 60 or a mounting plate 531. In the alternative, the LED 91, 103 are coupled to the mounting platform 92 and 102. The LED can be soldered onto a metal core PCB, mounting plate, or mounting platform. Thermal paste, thermal grease, soldering, reflow soldering or any other soldering materials or techniques known in the art can be used to couple the LED onto the metal core PCB, mounting plate, or mounting platform.

Metal Core PCB or Mounting Plate

Figure 12:
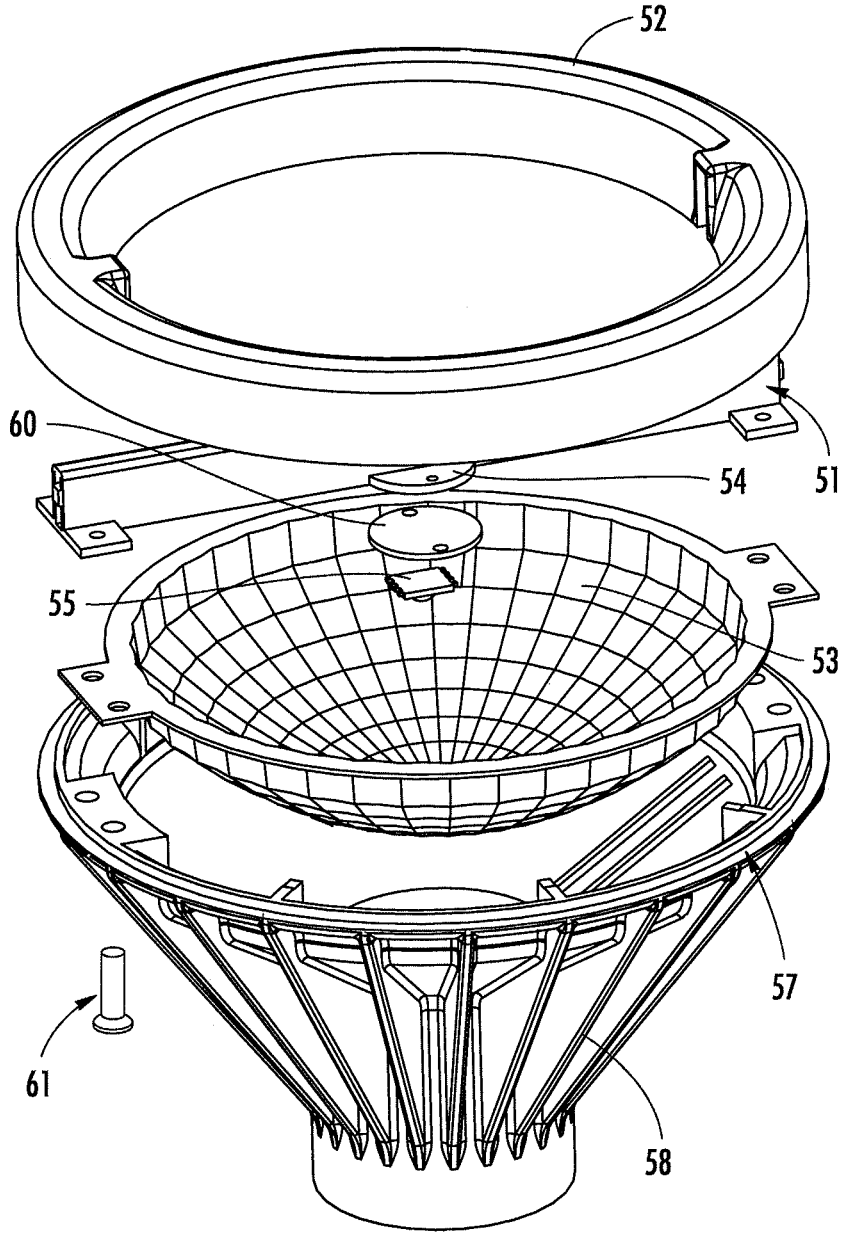
FIG. 12 is an exploded perspective view of the lighting apparatus shown in FIG. 8.
Figure 13:
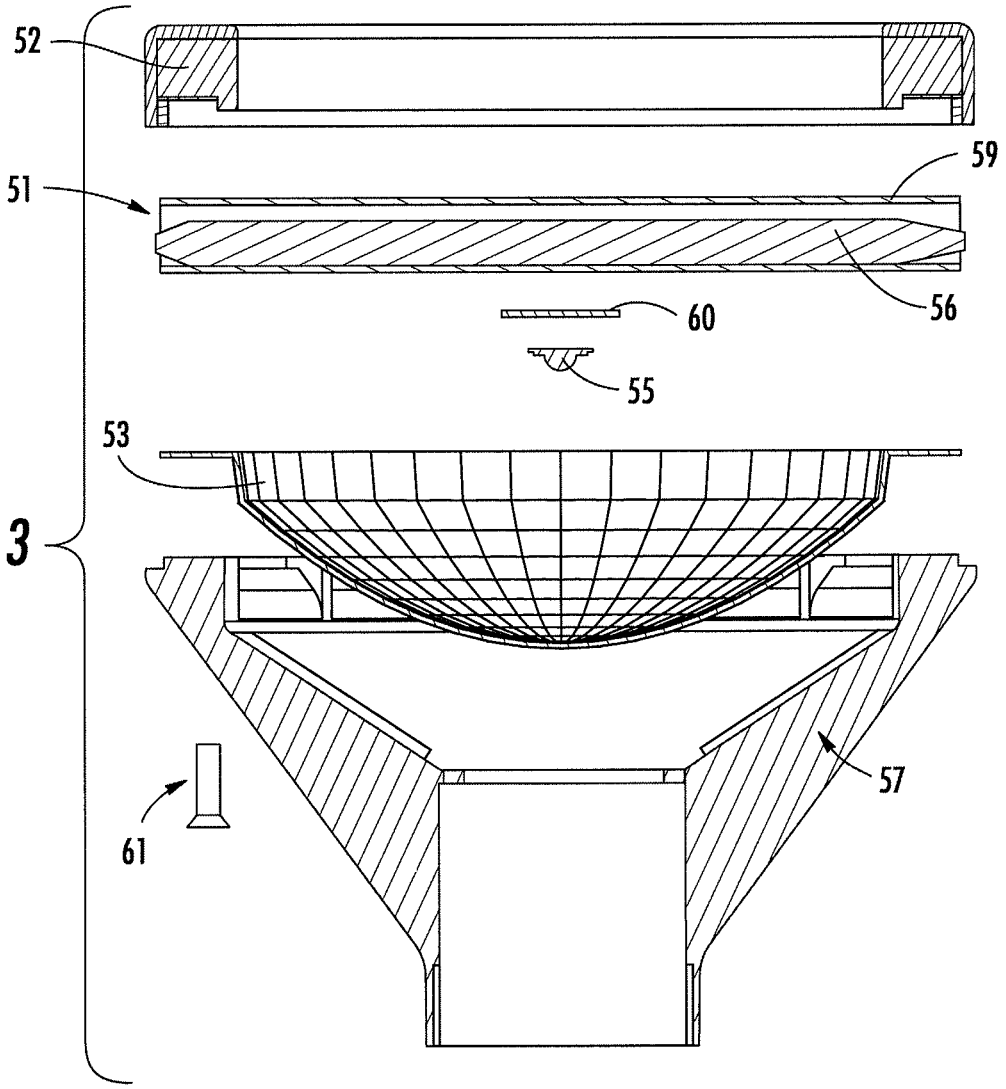
FIG. 13 is an exploded cross-sectional view of the lighting apparatus shown in FIG. 8.

The present invention includes a metal core PCB (see metal core PCB 7, 60 shown in FIGS. 3 and 12). The metal core PCB includes LED circuitry, and acts as a heat-transporting medium. For example, the metal core PCB comprises a base metal plate (copper or aluminum, which is approximately 0.8 to 3 mm thick), a dielectric layer (laminated on top of the base metal plate, which is approximately 0.1 mm thick), and a copper circuit track (printed on top of dielectric layer, which is approximately 0.05 to 0.2 mm thick).

Figure 16:
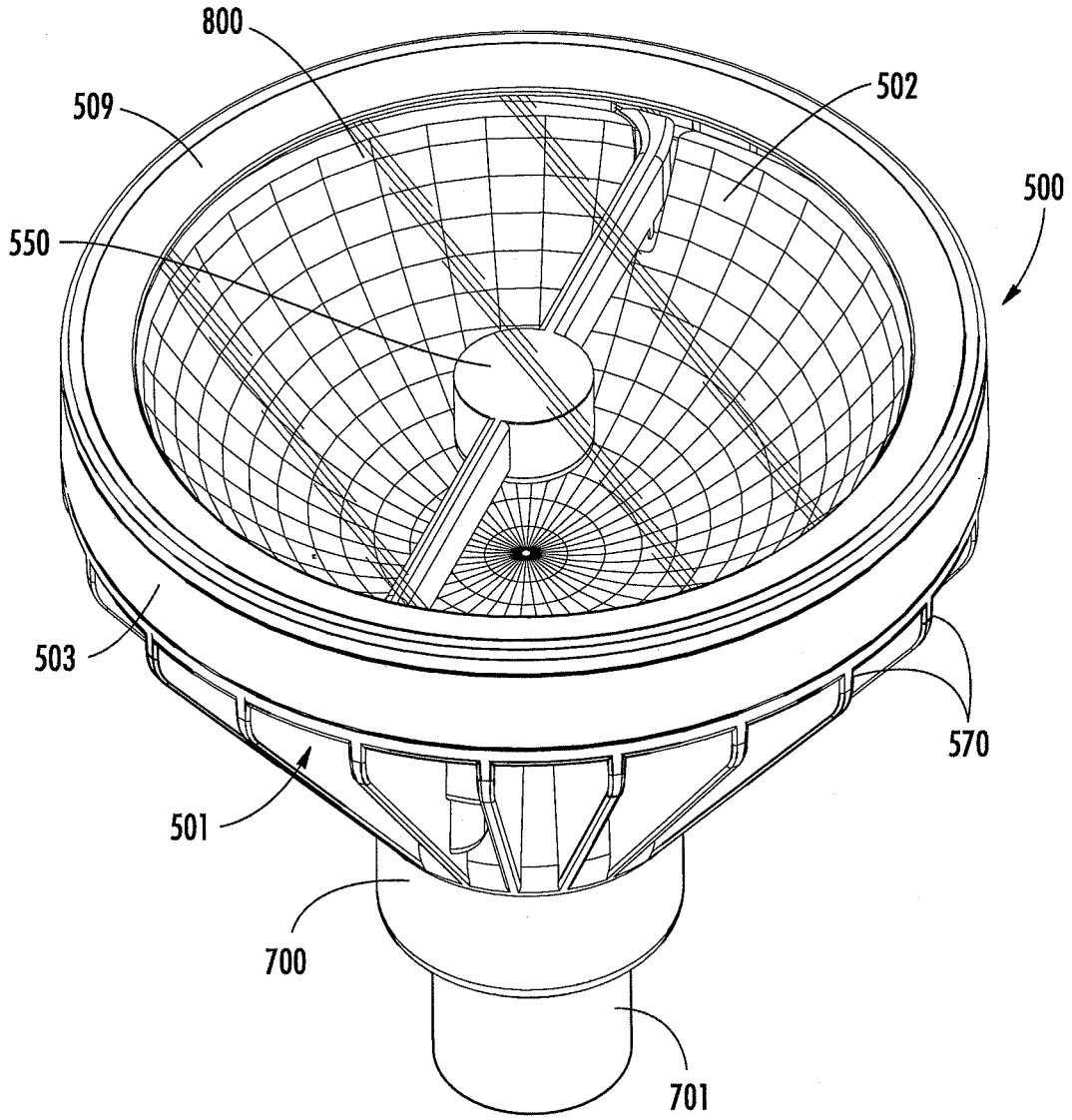
FIG. 16 is a perspective view of a lighting apparatus (which includes an S-shaped heat conducting body) according to another aspect of the present invention.

Alternatively, as shown in FIGS. 15 and 16, a metal core PCB is not included in the present invention in order to further reduce thermal resistance; thereby, reducing LED junction temperature and increasing maximum LED power.

Alternatively, as shown in FIG. 19, a mounting plate 531 is used, wherein the mounting plate 531 being coupled to the LED 504 and to the mounting platform 530. The mounting plate is made of a thermally-conductive material such as copper or any other high-heat conductive material, and approximately 0.8 to 3 mm thick. Mechanical techniques (such as screws) known in the art are used to couple the mounting plate to the mounting platform, and a thermal grease or paste with high thermal conductivity can be used between the mounting plate and mounting platform.

Top Rim and Cap Rim

The top rim 3, 52, 503 are made of a thermally-conductive material, such as aluminum, copper or zinc or any other high-heat conductive material. The top rim 3 acts as a primary heat sink (for example, see FIG. 1), or, like top rim 52, 503, as a secondary heat sink (for example, see FIGS. 8 and 18).

As shown in FIGS. 16 and 18, the present invention includes a cap rim 509 which helps secures the glass cover 800 to the top rim 503.

Main Housing, Plastic Housing and Lamp Base

Figure 17:
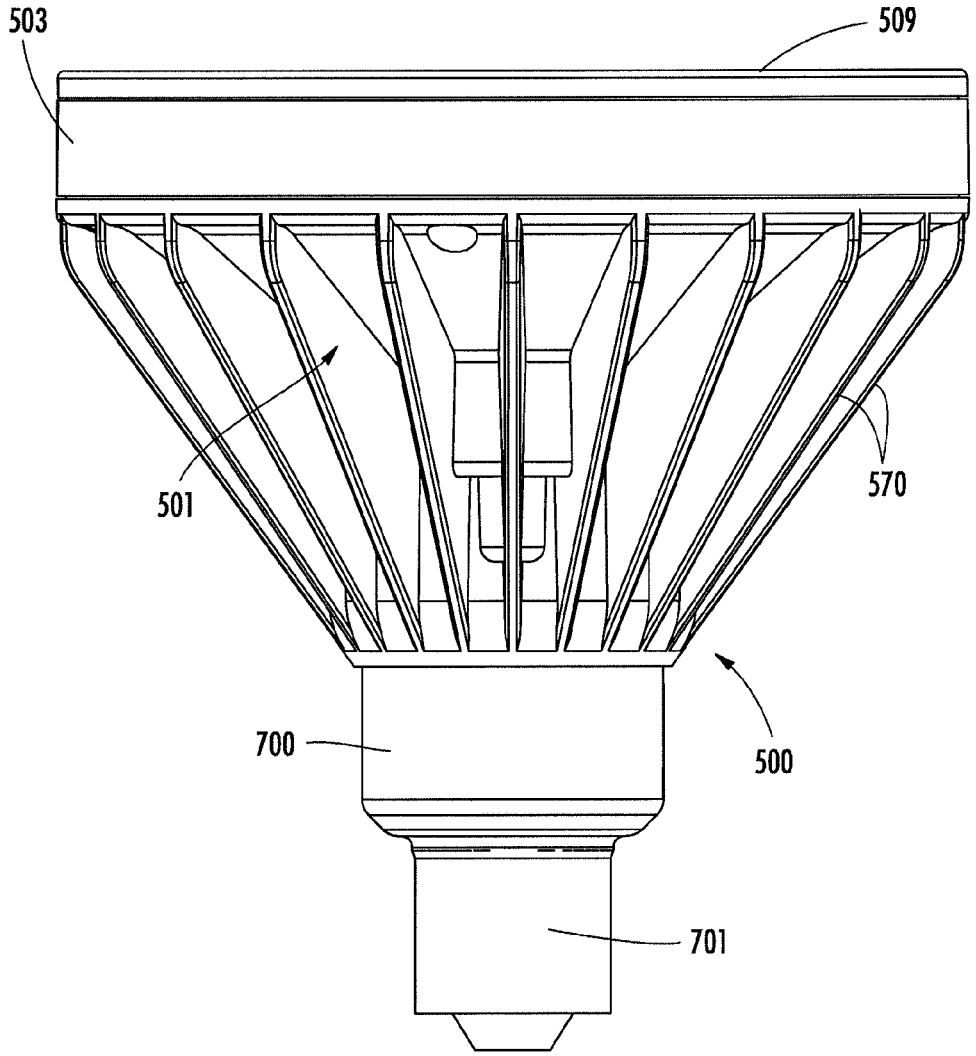
FIG. 17 is a side view of the lighting apparatus shown in FIG. 16.

The main housing 57, 501 are made of a thermally-conductive material, such as aluminum, copper, zinc or any other high-heat conductive material. The main housing 57, 501 act as a primary heat sink (for example, see FIGS. 8 and 17). As shown in FIGS. 8 and 17, the main housing 57, 501 can have one or more fins 58 or 570 and/or take a conical-like shape to increase its surface area in order to increase its heat dissipation capacity. The main housing 57, 501 can be substantially frustoconical in shape. The main housing can also be cylindrical or cubical in shape.

In an aspect of the present invention, one end of the main housing 57, 501 are coupled with a plastic housing 700, the plastic housing 700 coupled to a lamp base 701 (e.g., an E26 lamp base, a GU10 lamp base, an E27 lamp base, a GU24 lamp base). The plastic housing 700 contains main circuit boards, and electrically insulate such main circuit boards from the main housing 57, 501.

It will be appreciated by one skilled in the art that the main housing can be utilized in conjunction with the aspect of the present invention set forth in FIGS. 1-6, and the plastic housing 700 and lamp base 701 can be utilized with the aspects of the present invention shown in FIGS. 1-6 and FIGS. 8-13.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. A lighting apparatus comprising:

a main housing having a top end and a bottom end;

a plastic housing having a top end and a bottom end, the top end of the plastic housing coupled to the bottom end of the main housing, and a lamp base coupled to the bottom end of the plastic housing;

a reflector disposed within the main housing, the reflector having a front side and a rear side;

a circular top rim having a top platform, a bottom platform and two sidewalls that are each coupled between adjacent side edges of the top and bottom platforms, the circular top rim being coupled to the top end of the main housing, wherein one of the two sidewalls includes a plurality of sidewall slots;

a substantially S-shaped heat conducting body positioned to face the front side of the reflector and disposed within the circular top rim and between the top and the bottom platforms, the heat conducting body comprising a heat pipe thermally coupled to the circular top rim, the heat conducting body comprising a middle portion that is bar-shaped, and curved wing portions extending from the middle portion, each of the curved wing portions coupled to the circular top rim, wherein the circular top rim has slots in the top platform which permit each curved wing portion to fit and couple within the slots, wherein the plurality of sidewall slots are configured to permit the curved wing portions to fit and couple within the plurality of sidewall slots, and wherein the heat pipe is located in the middle portion and at least one of the curved wing portions; and at least one light-emitting diode thermally coupled to the heat conducting body, the at least one light-emitting diode being positioned to face directly at the front side of the reflector so that light emitted from the at least one light-emitting diode is directed to the front side of the reflector.

2. The lighting apparatus of claim 1, wherein the heat conducting body provides a pathway for heat to flow from the at least one light-emitting diode toward the circular top rim.

3. The lighting apparatus of claim 1, wherein the reflector has a central optical axis; the lighting apparatus further comprising:

a mounting platform located on one side of the heat conducting body facing opposite the front side of the reflector, coupled to the heat conducting body and positioned near or at the central optical axis of the reflector and thermally coupled to the at least one light-emitting diode.

4. The lighting apparatus of claim 3, wherein the mounting platform is made of copper or aluminum.

5. The lighting apparatus of claim 1, wherein the heat conducting body is bar-shaped, and wherein at least one end of the heat conducting body is thermally coupled to the circular top rim.

6. The lighting apparatus of claim 5, wherein the reflector has a central optical axis, and wherein one end of the heat conducting body is positioned near or at the central optical axis of the reflector, and is thermally coupled to the at least one light-emitting diode.

7. This lighting apparatus of claim 1, further comprising a metal cladding coupled to at least a substantial portion of the heat conducting body.

8. The lighting apparatus of claim 7, wherein the metal cladding is made of stainless steel, aluminum or copper.

9. The lighting apparatus of claim 1, wherein the reflector is in the shape of a hyperbola, ellipse or parabola.

10. The lighting apparatus of claim 1, wherein the circular top rim is made of a thermally-conductive material.

11. The lighting apparatus of claim 1, wherein the main housing is substantially frustoconical or cylindrical in shape, and is made of a thermally-conductive material.

12. The lighting apparatus of claim 1, wherein the main housing comprises one or more heat dissipating fins.

13. The lighting apparatus of claim 1, wherein the lamp base is an E26 lamp base, a GU10 lamp base, an E27 lamp base, or a GU24 lamp base.

14. The lighting apparatus of claim 1, further comprising:

a mounting plate thermally coupled to the at least one light-emitting diode; and a mounting platform thermally coupled to the mounting plate and the heat conducting body.

15. The lighting apparatus of claim 14, wherein the mounting plate is made of copper.

16. The lighting apparatus of claim 1, further comprising a glass cover coupled to the circular top rim, wherein the glass cover at least covers the reflector, the heat conducting body, and the at least one light-emitting diode from external environment.

17. A lighting apparatus comprising:

a main housing having a generally frustoconical shape with a top end and a bottom end;

a plastic housing having a top end and a bottom end, the top end of the plastic housing coupled to the bottom end of the main housing, and a lamp base coupled to the bottom end of the plastic housing;

a conic-shaped reflector disposed within the main housing, the conic-shaped reflector having a front side, a rear side and a central optical axis;

a circular top rim having a top platform, a bottom platform and two sidewalls that are each coupled between adjacent side edges of the top and bottom platforms, the circular top rim being coupled to the top end of the main housing, wherein one of the two sidewalls includes a plurality of sidewall slots;

a substantially S-shaped heat pipe positioned to face the front side of the conic-shaped reflector and disposed within the circular top rim and between the top and the bottom platforms, the substantially S-shaped heat pipe comprising a middle portion comprising a mounting platform located on one side of the heat conducting body and located at or near the central optical axis of the conic-shaped reflector, and two curved wing portions, the curved wing portions respectively coupled to each end of the middle portion and coupled within the circular top rim, wherein the circular top rim has slots on the top platform which permit each curved wing portion to fit and couple within the slots, and wherein the plurality of sidewall slots are configured to permit the curved wing portions to fit and couple within the plurality of sidewall slots; and at least one light-emitting diode thermally coupled to the mounting platform and positioned facing directly at the front side of the conic-shaped reflector so as that light emitted from the at least one light-emitting diode is directed to the front side of the conic-shaped reflector.

18. The lighting apparatus of claim 17, further comprising a metal core PCB coupled to the at least one light-emitting diode and the mounting platform.

19. The lighting apparatus of claim 17, wherein the lamp base is an E26 lamp base, a GU10 lamp base, an E27 lamp base, or a GU24 lamp base.

20. The lighting apparatus of claim 17, wherein the main housing comprises one or more heat dissipating fins.

* * * * *